US009492839B2

(12) United States Patent
Delgigante et al.

(10) Patent No.: US 9,492,839 B2
(45) Date of Patent: Nov. 15, 2016

(54) APPLICATOR FOR AN ADHESIVE LAVATORY TREATMENT COMPOSITION

(75) Inventors: Jesse Delgigante, Montvale, NJ (US); Francesc Ardite Ayats, Barcelona (ES)

(73) Assignee: Reckitt Benckiser LLC., Parsippany, NJ (US)

( * ) Notice: Subject to any disclaimer, the term of this patent is extended or adjusted under 35 U.S.C. 154(b) by 0 days.

(21) Appl. No.: 13/642,192

(22) PCT Filed: Apr. 19, 2011

(86) PCT No.: PCT/GB2011/050765

§ 371 (c)(1),
(2), (4) Date: Dec. 19, 2012

(87) PCT Pub. No.: WO2011/135330

PCT Pub. Date: Nov. 3, 2011

(65) Prior Publication Data

US 2013/0095238 A1 Apr. 18, 2013

(30) Foreign Application Priority Data

Apr. 28, 2010 (GB) ..... 1007066.2

(51) Int. Cl.
*B05C 1/00* (2006.01)
*B05C 17/005* (2006.01)
(Continued)

(52) U.S. Cl.
CPC . *B05D 1/00* (2013.01); *B25G 1/00* (2013.01); *B25G 3/18* (2013.01); *C11D 17/0056* (2013.01); *C11D 17/041* (2013.01); *E03D 9/022* (2013.01); *E03D 2009/026* (2013.01)

(58) Field of Classification Search
CPC .. C11D 17/0056; C11D 17/041; B05D 1/26; B05D 1/28; E03D 9/022; B65D 83/0005–83/005
See application file for complete search history.

(56) References Cited

U.S. PATENT DOCUMENTS 4,782,983 A * 11/1988 Cook ..... B65D 83/0005 116/307
6,667,286 B1 12/2003 Dettinger et al.
(Continued)

FOREIGN PATENT DOCUMENTS

DE 20217554 U1 4/2004
DE 102009051129 A1 6/2011
(Continued)

OTHER PUBLICATIONS

International Search Report for PCT/GB2011/050765 dated Jul. 5, 2011.
(Continued)

*Primary Examiner* — Dah-Wei D Yuan
*Assistant Examiner* — Stephen Kitt
(74) *Attorney, Agent, or Firm* — Norris McLaughlin & Marcus PA

(57) ABSTRACT

Disclosed is an applicator for an adhesive lavatory composition which comprises a quantity of an adhesive lavatory composition, and a piston part moveably engageable within a base part, wherein the piston part includes a piston plate and a grip element, and, the base part includes an upper cavity, a perforated compression plate, and a lower cavity, and, wherein the piston plate is fitted within the upper cavity of the base part and is moveable within the upper cavity of the base part. In certain embodiments the grip element may be detached from the piston plate and reused.

9 Claims, 8 Drawing Sheets

(51) Int. Cl.

| | |
|---|---|
| ***B05D 1/00*** | (2006.01) |
| ***B25G 1/00*** | (2006.01) |
| ***B25G 3/18*** | (2006.01) |
| ***C11D 17/00*** | (2006.01) |
| ***C11D 17/04*** | (2006.01) |
| ***E03D 9/02*** | (2006.01) |
| *B65D 83/00* | (2006.01) |

(56) References Cited

U.S. PATENT DOCUMENTS

| | | | | |
|---|---|---|---|---|
| 7,520,406 | B2 | 4/2009 | Jaichandra et al. | |
| 2006/0263140 | A1* | 11/2006 | Tani | A45D 40/04 401/55 |
| 2007/0007302 | A1* | 1/2007 | Jaichandra et al. | 222/47 |
| 2007/0106210 | A1 | 5/2007 | Fischer | |
| 2007/0187437 | A1 | 8/2007 | Lord | |
| 2008/0190457 | A1* | 8/2008 | Veltman et al. | 134/22.19 |
| 2012/0223360 | A1 | 9/2012 | Barchmann et al. | |
| 2013/0117917 | A1* | 5/2013 | Delgigante et al. | 4/232 |

FOREIGN PATENT DOCUMENTS

| | | | |
|---|---|---|---|
| EP | 1978080 | A1 | 10/2008 |
| EP | 2141221 | A1 | 1/2010 |
| WO | 03043906 | A1 | 5/2003 |
| WO | 2004043825 | A1 | 5/2004 |
| WO | 2007008531 | A1 | 1/2007 |

OTHER PUBLICATIONS

Wriiten Opinion if the International Searching Authority for PCT/GB2011/050765 dated Jul. 5, 2011.

GB Search Report for GB 1007066.2 dated Jun. 25, 2010.

International Search Report for PCT/GB2011/050839 dated Aug. 12, 2011.

Wriiten Opinion if the International Searching Authority for PCT/GB2011/050839 dated Aug. 12, 2011.

English Language Translation for DE 20217554U1 dated Apr. 29, 2004.

GB Search Report for GB 1007064.7 dated Oct. 21, 2010.

* cited by examiner

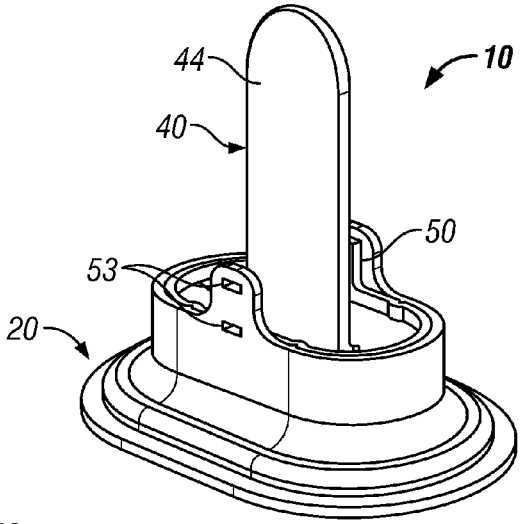
FIG. 4A1
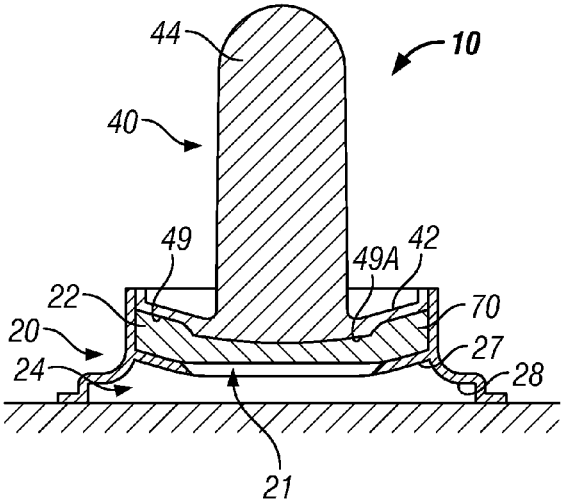
FIG. 4B1
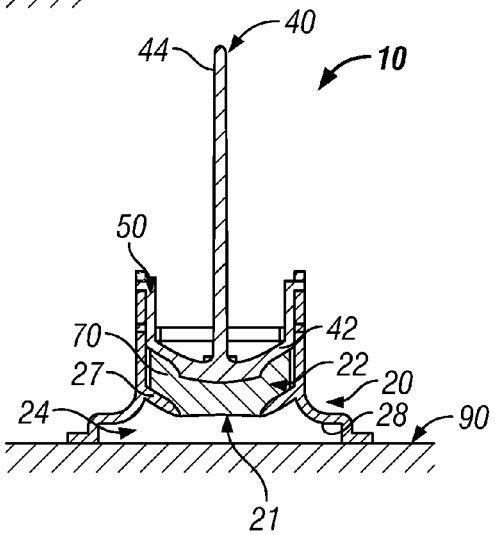
FIG. 4C1

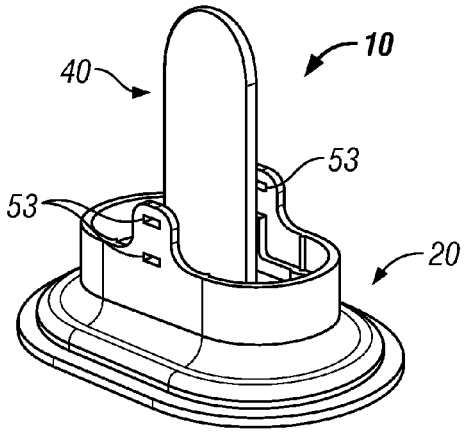
FIG. 4A2
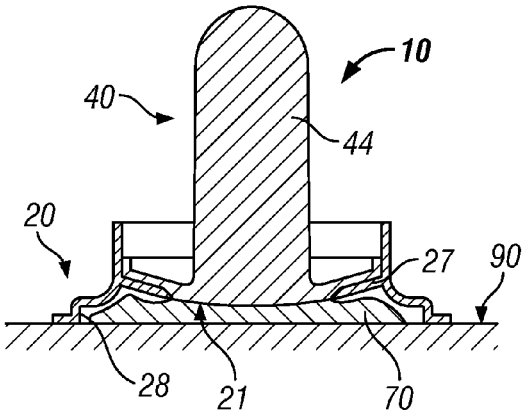
FIG. 4B2
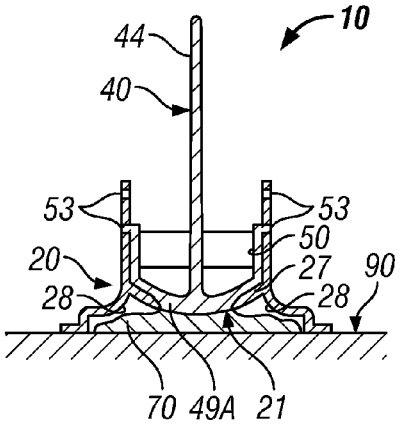
FIG. 4C2

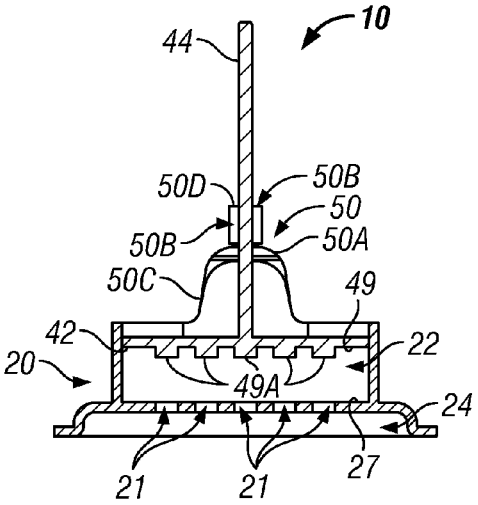
FIG. 5A1
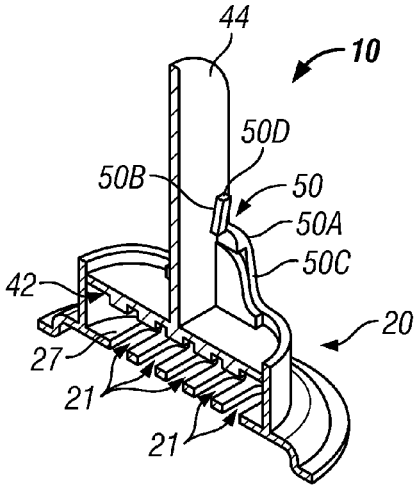
FIG. 5A2
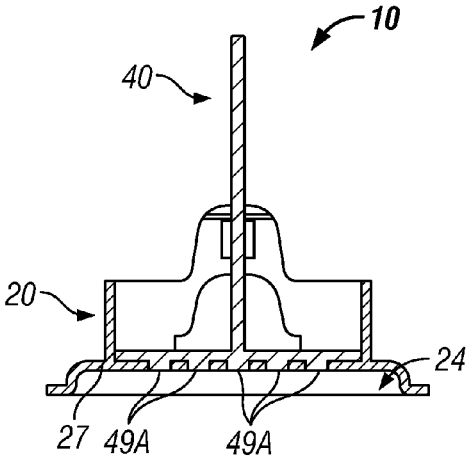
FIG. 5B1
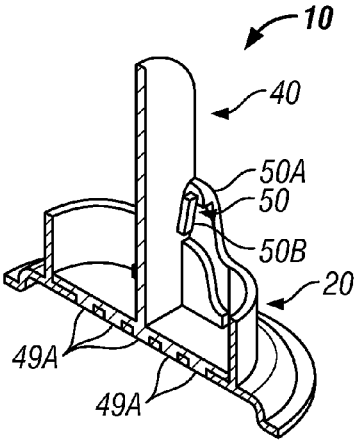
FIG. 5B2

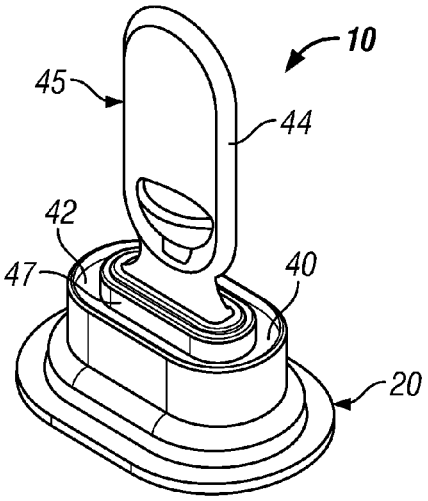
FIG. 6A1
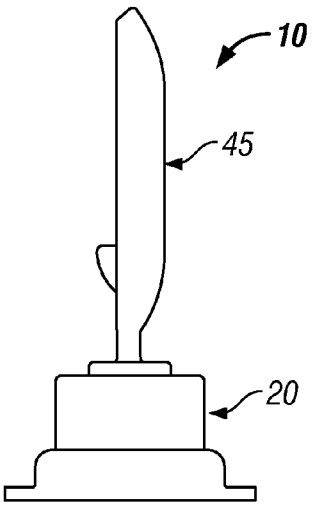
FIG. 6A2
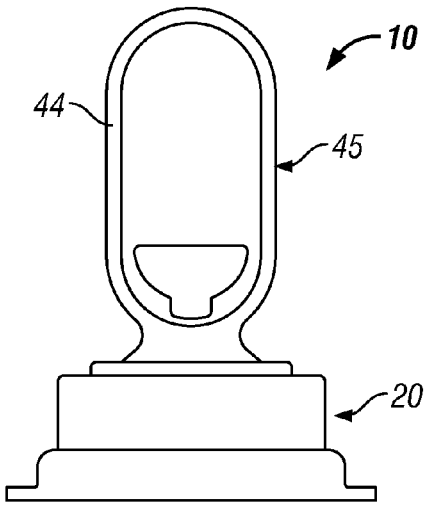
FIG. 6A3

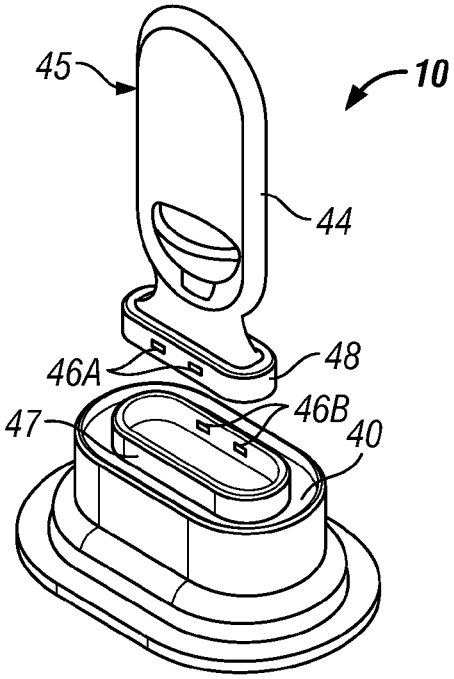
FIG. 6B1
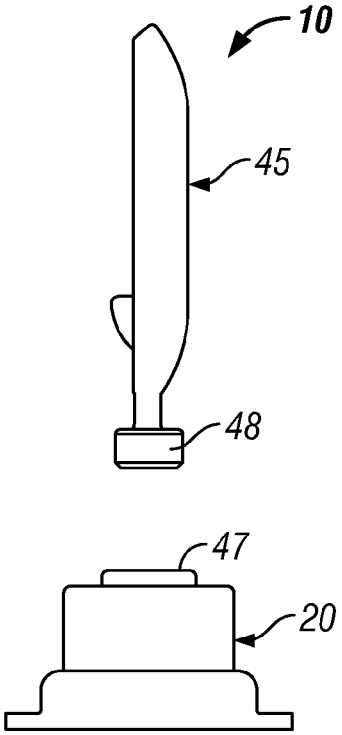
FIG. 6B2
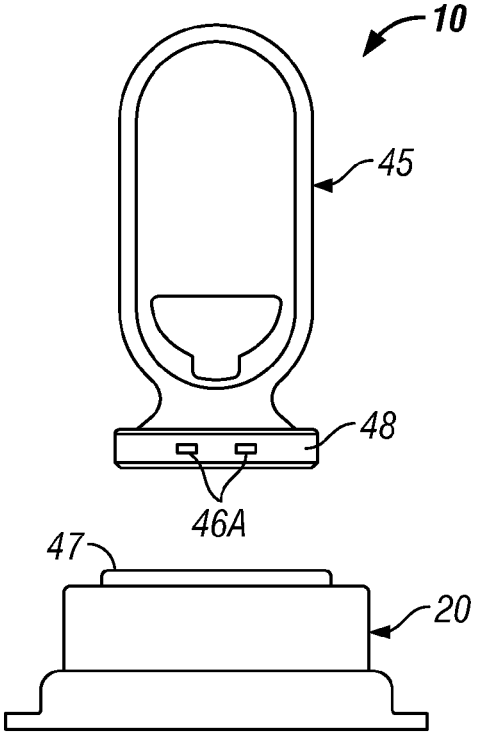
FIG. 6B3

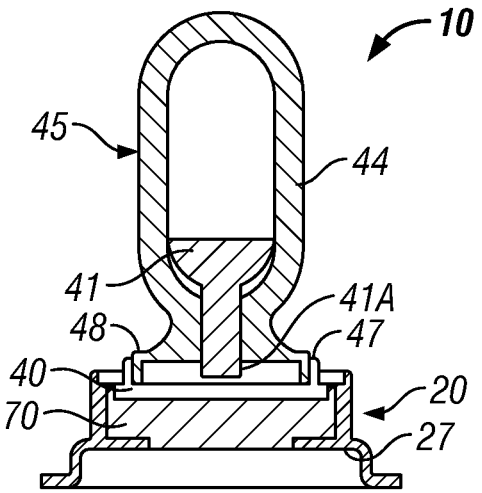
FIG. 6C1
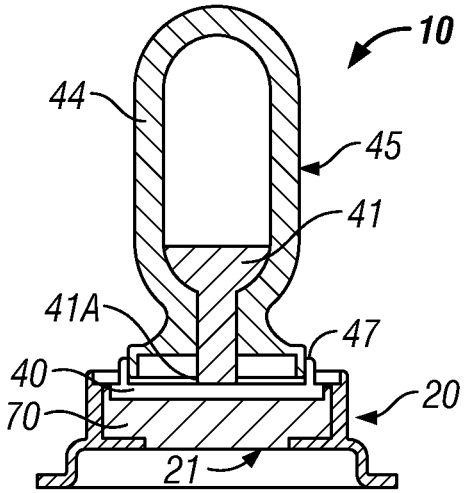
FIG. 6C2
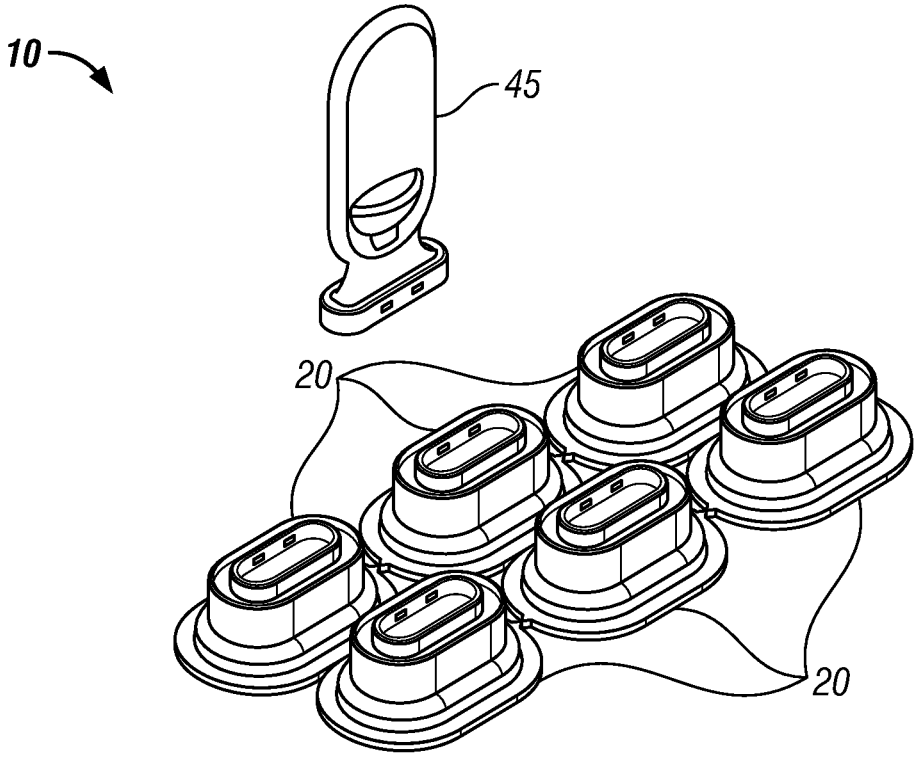
FIG. 7

APPLICATOR FOR AN ADHESIVE LAVATORY TREATMENT COMPOSITION

This is an application filed under 35 USC 371 of PTC/GB2011/050765,which in turn claims priority to GB 1007066.2 filed 28 Apr. 2010.

The present invention relates to an applicator for an adhesive lavatory treatment composition.

Lavatory treatment compositions, namely compositions which comprise one or more chemical constituents which are intended to provide one or more technical benefits to lavatory appliance are well known to the art. These include without limitation: liquid treatment compositions, solid treatment compositions particularly those which are intended to be provided as solid blocks, cakes, tablets, pastes, or self-supporting gels which may be provided to the upper tank or cistern of a toilet, or provided to a part of a toilet bowl such as when provided in a suitable applicators such as a cage, are well known to the art. Such lavatory treatment compositions can provide as technical benefits one or more of, e.g., a cleaning benefit, a disinfecting benefit, sanitizing benefit, an antiresoiling resistant benefit, a fragrancing benefit, and/or an air treatment benefit. Provision of two or more technical benefits are also known to the art.

More recently, so-called "adhesive lavatory treatment compositions" have been introduced to the art. These are generally pastes, or gels which may be directly applied to a portion of a toilet or other lavatory appliance. Such adhesive lavatory treatment compositions include, inter alia., those disclosed in U.S. Pat. No. 6,667,286 B1 as well as those disclosed in US 2008/190457. Such adhesive laboratory treatment compositions are intended to be applied directly to a wetted or wettable surface of the lavatory appliance, particularly to the interior sidewall of a toilet bowl. In use, said compositions are said to resist being washed away when flushed with water such as during a normal flushing operation. Such resistance to being washed away may vary over time and/or the number of flushes to which an adhered lavatory treatment composition is subjected.

Such adhesive lavatory treatment compositions however require that they be applied to a surface. Due to the sticky or adhesive nature of said compositions, an applicator of some type is typically required. Such have also been proposed in the art. For example, an applicator disclosed in U.S. Pat. No. 7,520,406 provides a means whereby multiple doses of adhesive lavatory treatment composition may be applied before the quantity of said composition provided by the applicator is exhausted. A further, simpler applicator is disclosed in US 2008/190457 which provides a pouched single-dose mass of an adhesive lavatory treatment composition which may be manually applied by a consumer. While this latter simple applicator is studied to provide a useful device for dispensing a unit dose, disadvantageously it requires consumers to come into very close proximate contact, or indeed to come into direct contact with, the interior surface of a toilet bowl. Such is disliked by many consumers. Furthermore, the pouched single-dose mass disclosed in US 2008/190457 and methods of its application are strongly dependent upon the placement of the single-dose mass, as well as the application of pressure transmitted through one or more fingers of the consumer applying the said single-dose mass in order to ensure proper application. However, this is highly variable between consumers and may not lead to a high probability of successful application of the single-dose mass of an adhesive lavatory treatment composition to a surface.

It is to these and further limitations in the art that the present invention is directed.

A first aspect of the present invention provides an applicator for an adhesive lavatory treatment composition.

A second aspect of the present invention provides an applicator for an adhesive lavatory treatment composition, which includes a reuseable part.

A third aspect of the present invention provides a method for applying an adhesive lavatory treatment composition, preferably a single dose or unit dose of said composition, to the surface of a lavatory appliance.

A fourth aspect of the present invention provides a method for the manufacture of an applicator for an adhesive lavatory treatment composition for said adhesive lavatory treatment composition.

FIGS. 4A1, 4A2, 4A3, 4B1, 4B2 and 4B3 illustrate various cross-sectional views of a further applicator in a plurality of different configurations.

Figure 1:
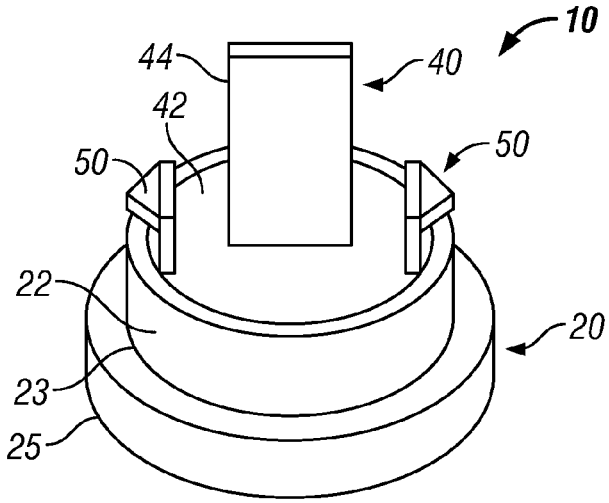
FIG. 1 depicts a perspective view of a first embodiment of an applicator of the invention.
Figure 2:
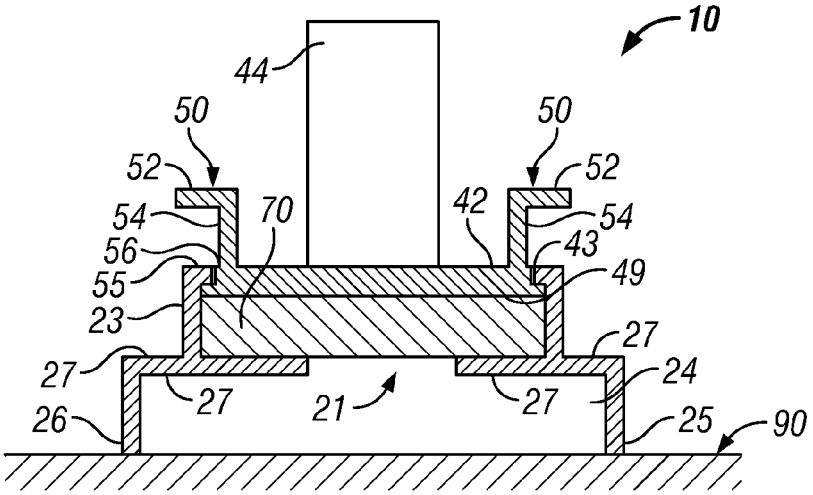
FIG. 2 is a cross sectional view of the applicator of FIG. 1.

FIGS. 4C1, and 4C2 illustrate various cross-sectional views of an applicator in different configurations.

FIGS. 5A1, 5A2, 5B1 and 5B2 depict a further embodiment of an applicator in various cross sectional views.

FIGS. 6A1, 6A2, 6A3, 6B1, 6B2 and 6B3 illustrate a two-part applicator according to the invention in various views.

FIGS. 6C1 and 6C2 depict in cross-section a further embodiment of a two-part applicator according to the invention.

FIG. 7 illustrates an embodiment of the invention wherein a handle and a plurality of base parts of an applicator according to the invention are supplied to a consumer.

FIGS. 8A, 8B, 8C and 8D illustrate a method of applying a unit dose of an adhesive lavatory treatment composition using an applicator of the invention to the inner sidewall of a toilet bowl.

These and further aspects of the invention will be understood from consideration of the following specification and accompanying drawings.

The applicators of the present invention may be used to dispense known-art adhesive lavatory treatment compositions, e.g., treatment compositions as disclosed in U.S. Pat. No. 6,667,286 B1 as well as disclosed in U.S. 2008/190457, the contents of each of these documents being herein incorporated by reference. It is contemplated that virtually any solid, gel, or paste lavatory treatment composition which can be effectively retained within the applicators described herein, and thereafter be applied to a surface fall within the scope of the present invention.

In preferred embodiments, applicators of the invention are adapted or intended to dispense a single mass or quantity of an adhesive lavatory treatment composition, after which one or more parts of, or alternately, all of the said applicator is disposed without refilling of the applicator. In such manner, a specific mass, or metered quantity of an adhesive lavatory treatment composition is provided within each applicator, and with each use, most, or all of the said composition is delivered from the said applicator, and onto a surface, particularly an inner sidewall of at lavatory appliance, especially particularly an inner sidewall of a toilet bowl.

In other, albeit lesser preferred embodiments, the applicators of the invention may be used two or more times in the delivery of quantities of an adhesive lavatory treatment composition before being discarded, disposed of, or refilled with a fresh quantity of an adhesive lavatory treatment composition and thereafter reused.

Various configurations of the inventive applicators according to the present invention, including certain particularly preferred embodiments, are depicted on the following figures. In the accompanying figures, like elements are indicated using the same numerals throughout the figures.

FIG. 1 depicts a perspective view of a first embodiment of an applicator 10 of the invention. The applicator is a two-part applicator comprising a base section 20 movably engageable with a piston part 40. The piston part 40 includes a piston plate 42 which is fitted within an upper cavity 22 of the base section 20. The piston part 40 also includes a grip element 44 here in the shape of a paddle which is adapted to be gripped by a user of the applicator 10 when applying an adhesive lavatory treatment composition. Advantageously the grip element 44 is perpendicular to the piston plate 42 of the piston part 40. The grip element 44 is depicted to be generally perpendicular to the base section 20 but any other configuration of either of these parts is permitted. Optionally, but preferably as a shown in FIGS. 1 and 2 the piston part 40 also includes a pair of stop means 50. Each of the stop means 50 includes a base 56, a stalk 54 and an offset head 52 which last element extends outwardly from the grip element 44. The base section 20, according to preferred embodiments is bell-shaped and includes a first or upper cavity 22 and a second or lower cavity 24, which terminates at a base face 26. In the depicted embodiment, the first or upper cavity 22 is defined by a first circular sidewall 23, a bottom face 49 of the piston plate 42 and the second or lower cavity 24, which in turn is defined by a second circular sidewall 25, a perforated compression plate 27 intermediate the first or upper cavity 22 and the second or lower cavity 24. The first or upper cavity 22 also defines a piston bore, within which at least the piston plate 42 travels towards the perforated compression plate 27 and its (at least one) orifice 21. Such is more clearly understood with reference now to FIG. 2 which is a cross sectional view of the applicator 10 of FIG. 1. As visible on FIG. 2, the piston plate 42 extends transversely within the first circular sidewall 23. To limit the withdrawal of the piston part 40 in the direction of the grip element 44, the applicator 10 includes a piston removal stop means, here a pair of cooperating elements, namely a circumferential recess element 43 present in the piston plate 42, here a step-like recess and a cooperating inwardly extending circular extension 55 extending from a part of the first circular sidewall 23. Thus the recess element 43 and the extension 55 delimit the removal of the piston part 40 from the base section 20 when pulled away therefrom. When the piston part 40 is moved in the direction of the base section 20, the pair of stop means 50 present are dimensioned such that a part thereof, here the offset heads 52 come into contact with part of the first circular sidewall 23 such that further inward motion of the piston part 40 and its base section 20 is halted. In preferred embodiments, the dimensions of the respective piston part 40, base section 20 and stop means 50 are desirably selected such that when the pair of stop means 50 (or part(s) thereof) engage a part of the base section 20 to thus halt further inward motion of the piston part 40, such that the bottom face 49 of the piston plate 42 comes into contact, preferably interfacial contact with the perforated compression plate 27. Such is particularly advantageous as when considering preferred embodiments, the dose of an adhesive lavatory treatment composition 70 is compressed between the piston plate 42 and the perforated compression plate 70, which forces or extrudes the said adhesive lavatory treatment composition 70 contained within the volume of the first or upper cavity 22 through the orifice 21 such that most or all of the adhesive lavatory treatment composition 70 is extruded through the orifice 21 and preferably onto a surface 90 to which the adhesive lavatory treatment composition 70 may be adhered. The benefit thereof is discussed in greater detail in the following figures. Further, advantageously according to preferred embodiments the volume of the first or upper cavity 22 is also less than the volume of the second or lower cavity 24, the benefits of which are also discussed in greater detail in the following figures. FIG. 2 also illustrates a preferred placement of the applicator 10 on a surface 90 where the base face 26 abuts the surface 90. FIG. 2 also illustrates a mass of an adhesive lavatory treatment composition 70, here a single use "dose" thereof within the applicator 10, which preferably fills the volume of the first or upper cavity 22 between the piston plate 42 and the perforated compression plate 70 above the orifice 21, although the adhesive lavatory treatment composition 70 may also extend into the orifice 21 albeit not illustrated in the figure.

Figure 3:
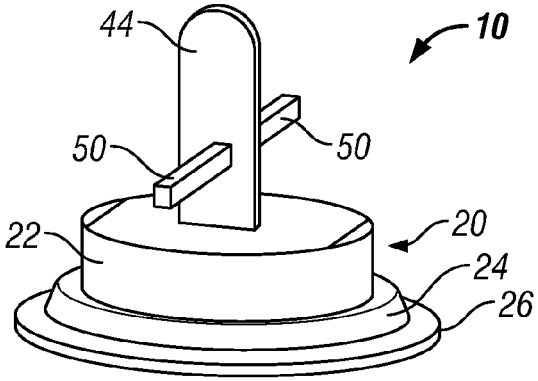
FIG. 3 depicts a perspective view of a second embodiment of an applicator of the invention.

FIG. 3 depicts a perspective view of a second embodiment of an applicator of the invention. The second embodiment differs in several respects from the first embodiment of FIG. 1, primarily in that whereas the piston plate 42, and the first or upper cavity 22 and the second or lower cavity 24 were circular in configuration, these elements in the second embodiment assume a more rectangular configuration with curved corners. Further, the stop means 50 comprises a pair of outwardly extending, generally perpendicular arms extending from opposite faces of the grip element 44.

A more detailed understanding of the interrelationship of the various parts of a third and preferred embodiment, and a preferred mode of applying a mass of an adhesive lavatory treatment composition, here a single use "dose" thereof, is described with reference to FIGS. 4A1, 4B1, and 4C1, as well as on FIGS. 4A2, 4B2 and 4C2. Prior to discussing these figures it is to be understood is that said figures are presented as "paired" representations, namely FIG. 4A1 depicts a perspective view of the applicator 10 in first configuration and FIG. 4A2 illustrates the same applicator in a perspective view but in a second configuration. FIG. 4B1 depicts a cross-sectional view of the applicator 10 from a side thereof in first configuration and FIG. 4B2 illustrates the same applicator in a cross-sectional view in a second configuration. FIG. 4C1 depicts a cross-sectional view of the applicator 10 from an end thereof in a first configuration and FIG. 4C2 illustrates in a cross-sectional view of the same applicator in a second configuration. These respective views illustrate the relative positions of the piston part 40, piston plate 42, perforated compression plate 27 intermediate the first or upper cavity 22 and the second or lower cavity 24, base section 20, and of the mass of an adhesive lavatory treatment composition 70, here provided as a single use "dose" thereof within the applicator 10 and with respect to the surface 90, in FIGS. 4A1, 4B1 and 4C1, in an initial state prior to any movement of the piston part 40 within the base section 40, then in FIGS. 4A2, 4B2 and 4C2 in the final state and subsequent to maximum movement of the piston part 40 within the base section 20, wherein the stop means 50 are engaged with parts of the base section 20, here corresponding detents 53 in parts of the base section 20 which inhibits or denies refraction of the piston part 40 form the base section 20, and which also inhibits or denies further inward movement of the piston part 40 into the base section 20, such that the bottom face 49 of the piston plate 42 is in contact with, and especially preferably in interfacial contact with the perforated compression plate 27. The movement of the piston part 40 in relation to the base section 20 from the first configuration to the second configuration as illustrated also ensures that the adhesive lavatory treatment composition 70 is compressed between the piston plate 42 and the perforated compression plate 27, which forces or extrudes the said adhesive lavatory treatment composition 70 contained within the volume of the first or upper cavity 22 through the orifice 21 such that most or all of the adhesive lavatory treatment composition 70 is extruded through the orifice 21 and preferably onto a surface 90 to which the adhesive lavatory treatment composition 70 may be adhered. This compression imparts shear forces in the adhesive lavatory treatment composition 70 as it passes through the orifice 21, and concurrently ensures good interfacial contact with the surface 90. When the parts of the applicator are appropriately configured, specifically the shape and/or contour of the piston plate 42 and the perforated compression plate 27, then the maximum delivery of the mass or dose of the adhesive lavatory treatment composition 70 can be expelled out from the volume of the first or upper cavity 22 and onto the surface 90. Further preferably, the volume of the first or upper cavity 22 is also less than the volume of the second or lower cavity 24, such when the piston part 40 is at its maximum displacement within the base section 20, as depicted on FIGS. 4B2 and 4B3, ideally none of the compressed and laterally deformed mass of the adhesive lavatory treatment composition 70 comes into contact with the interior 28 of the second or lower cavity 24. Such minimizes the likelihood of undesired adhesion between any other part of the applicator 10 other than the piston part 40 exposed through the orifice 21. Such minimizes the likelihood that the applied mass of the adhesive lavatory treatment composition 70 will be inadvertently removed when the applicator 10 is withdrawn.

FIGS. 5A1, 5A2, 5B1 and 5B2 depict a further embodiment of an applicator 10 according to the invention in several views. FIG. 5A1 illustrates a cross-sectional view of an applicator 10 in a first configuration and FIG. 5A2 illustrates the same cross-section in a perspective view, while FIG. 5B1 illustrates a cross-sectional view of the applicator 10 in a second configuration and FIG. 5B2 illustrates the same cross-section in a perspective view. In these figures, the mass of an adhesive lavatory treatment composition 70, here provided as a single use "dose" thereof within first or upper cavity 24 of the applicator 10 has been omitted for sake of clarity of the figures but is normally present therein. As visible from these figures, the piston part 40 includes a piston plate 42 which is fitted within an upper cavity 22 of the base section 20, which piston plate 42 includes a plurality of piston plugs 49A which extend outwardly from the bottom face 49 of the piston plate 42 and which are dimensioned to extend into corresponding orifices 21 of the perforated compression plate 27. In use the mass or dose of the adhesive lavatory treatment composition 70 is compressed between the piston plate 42 and the perforated compression plate 27, which forces or extrudes the said adhesive lavatory treatment composition 70 contained within the volume of the first or upper cavity 22 through the orifices 21, with the piston plugs 49A also forcing the said adhesive lavatory treatment composition 70 from within the orifices 21.

The embodiment of the applicator 10 disclosed within these figures also depicts an alternate embodiment of a stop means 50 which comprises a flexible tang 50A formed as an extension 50C of the sidewall 23 of the first or upper cavity 22, which cooperatively engages with one or more angled lock segments 50B which extend outwardly from the grip element 44. When the applicator 40 is in its first configuration the angled lock segments 50B are disengaged from and above the flexible tangs 50A, but as the applicator 40 is configured to its second configuration by movement of the piston part 40 into the base part 20, the angled lock segments 50B of the inwardly moving grip element 44 come into sliding engaging contact with the flexible tangs 50A and flex them outwardly and away from the grip element 44 until the ends 50D of the angled lock segments 50B are reached, and the flexed flexible tangs 50A are allowed to return to their prior unstressed configuration. In this second configuration of the applicator 10, the removal and disengagement of the piston part 40 into the base part 20 is inhibited or denied by the placement of the angled lock segments 50B and the final position of the flexible tangs 50A which abut one another as more clearly depicted on FIG. 5B2. It is to be further understood that the such a stop means 50 may also provide an audible signal, such as a "click" or "snap" which may be heard by a consumer and provide a means of feedback to the consumer as preferably the applicator 10 is dimensioned such that the ends 50D of the angled lock segments 50B pass the flexible tangs 50A when the piston part 40 is fully seated within the base part 20 and the adhesive lavatory treatment composition 70 contained within the applicator has been extruded, and as the ends 50D of the angled lock segments 50B pass the flexible tangs 50A such an audible signal is generated.

Other embodiments of stop means 50 disclosed herein, e.g., the embodiment of FIGS. 4A1, 4B1, 4C1, 4A2, 4B2 and 4C2 may also be configured to provide an audible signal to a consumer indicating that the adhesive lavatory treatment composition 70 contained within the applicator has been extruded from the applicator 10.

FIGS. 6A1, 6A2, and 6A3 illustrate various view of a further embodiment of an applicator of the invention in a first configuration, and FIGS. 6B1, 6B2, and 6B3 illustrate further view of the said applicator in a second configuration. The applicator 10 is a two-part applicator comprising a base section 20 having contained therein a movably engageable piston part 40, and a handle 45. The piston part 40 comprises a piston plate 42, and a receptacle 47 adapted to retain the base 48 of a handle 45 when it is engaged within. While a friction-type fit may be sufficient to retain the base 48 of the handle 45 within the receptacle 47, optionally but preferably one or more interlocking elements may be present, here illustrated as a series of cooperating grip pins 46A and grip holes 46B, which are removably engageable. The handle 45 is removably engageable within the receptacle 47, which permits for one handle 45 to be used with several base sections 20. Further details of the preferred embodiment of the handle 45 are disclosed in FIGS. 6C1 and 6C2 which illustrate in cross-sectional views the applicator 10. The handle 45 includes a grip part 44 and a slideable release pin 41. In the embodiment depicted on FIG. 6C1, the handle 45 is engaged with the base part 20 via the receptacle 47 adapted to retain the base 48 of a handle 45. The release pin 41 has an end 41A which extends in the direction of the piston plate 42 and extends into the receptacle 47. When the handle 45 is so engaged, the slideable release pin 41 is in a retracted position wherein it may either abut the piston plate 42 and extends into the receptacle 47 (not shown) or it may even be slightly spaced apart therefrom, as is illustrated. When it is desired to disengage the handle 45 from the base part 20, a consumer or user may manually push the slideable release pin 41 in the direction of the piston plate 42, which causes the end 41A to push against the piston plate 42 and urge the base 48 of the handle 45 out from the receptacle 47. In this manner, a handle 45 may be used to disengage a spent base part 20 without requiring the user or consumer to touch the base part 20 after the adhesive lavatory treatment composition 70 has been dispensed from the applicator 10.

Applicators of the invention may be packaged and sold as single vendible articles, or a plurality of such applicators may be packed and sold as a vendible article; such an embodiment of the applicator 10 as depicted on FIG. 7. In such case, at least one handle 45 (or piston part 40) packaged with a plurality of base parts 20 are supplied in suitable packaging, e.g., in a tray or container which may be resealable by a consumer.

FIGS. 8A, 8B, 8C and 8D illustrate a method of applying a unit dose of an adhesive lavatory treatment composition using an applicator according to FIG. 3 to the inner sidewall of a toilet bowl. As is visible thereon, in FIG. 8A an applicator 10 generally similar to that described with reference to FIG. 3 is manually grasped by its grip element 44 and with the user peels away a removable cover film 80 with the other hand from the base section 20 thereby exposing a unit dose of a mass of the adhesive lavatory treatment composition 70 with the interior of the base section 20. The removable cover film 80 is discarded. In the next step depicted on FIG. 8B, the user grasping the grip element places the base section 20 against an inner sidewall 88 of a toilet bowl, and pushes the grip element 44 in the direction of arrow "A", and towards the sidewall which dispenses the mass of the adhesive lavatory treatment composition 70 from the applicator 10 and onto the sidewall 88. In the next step depicted on FIG. 8C, after the grip element 44 has been fully compressed and the mass of the adhesive lavatory treatment composition 70 has been adhered to the sidewall 88 as shown, the user has pulled the applicator 10 away from the deposited and adhered mass 70 and in the direction of arrow "B" and away from the sidewall. In the next (optional) step, the spent applicator 10 is properly disposed of, e.g. as recyclable plastic materials. While not illustrated it is to be understood that the above method can also be practiced with a two-part applicator of the invention, in which process the handle 45, e.g., such as in FIG. 7 would be retained, and a spent base part 20 would be properly disposed, but the handle 45 retained for further reuse.

The applicators of the invention may be manufactured or formed from any suitable material of construction. Advantageously, applicators are manufactured, such as by injection molding, from a suitable synthetic polymer. Nonlimiting examples of suitable synthetic polymer materials include, but are not limited to polyamides (e.g., nylons), polyolefins (e.g., polypropylene, polyethylene) as well as polyalkylene-terephalates (e.g., polyethylene terephthalate, polybutylene terephthalate), polystyrenes, polysulfones, polycarbonates as well as copolymers formed from monomers of one or more of the foregoing synthetic polymers. Other naturally occurring or synthetic but may also be used although not specifically described herein, it only being required that the selected polymer or copolymer be fabricable into applicators as described herein. Other formable materials, e.g., metals, paper such as coated papers may also be used in the manufacture of all or parts of the applicators taught herein. After being manufactured and when necessary, assembled, a quantity an adhesive lavatory treatment composition may be provided to part of said applicator, where it may be retained until it is subsequently dispensed from the applicator to a surface by a consumer.

Any of the parts, or surfaces of the applicator 10 may be formed of a release material, or may have applied thereto, a release material, e.g., a material which has poorer interfacial adhesivity with the treatment composition 70. Such a release material may be provided as a coating, e.g. to one or more parts of the applicator 10, e.g., to the piston plate 42 and/or first or upper cavity 22 and a second or lower cavity 24, or such a release material may also be provided as a further element or part of the applicator 10, e.g. a plate which may be fitted or positioned intermediate the piston plate 42 and the mass of the composition 42, or a sheet, film or cup which may be adhered to or fitted to one or more parts of the applicator 10. Such a release material may be present in the applicator 10 prior to it being supplied with the treatment composition 70.

Figure 8A:
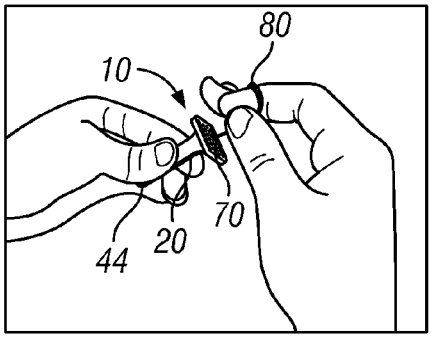
Figure 8B:
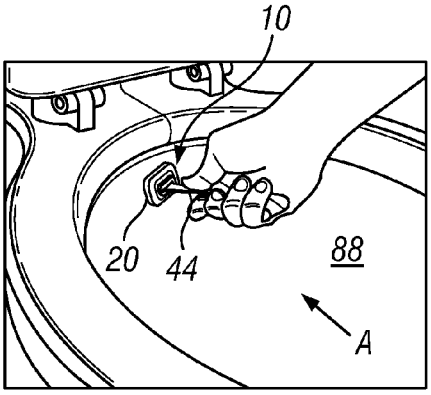
Figure 8C:
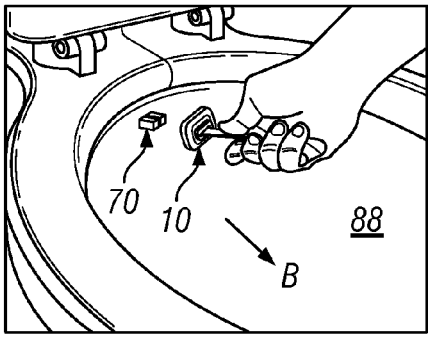
Figure 8D:
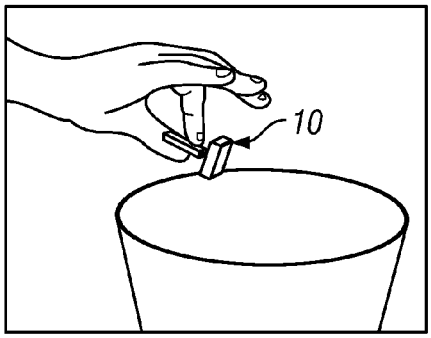

As discussed with reference to FIG. 8A, the applicator of the invention may further include a cover film or sheet of barrier material which advantageously spans the open base of the base section 20, and preferably is removably adhered to the base face 26. After manufacture of the applicator containing a mass of the adhesive lavatory treatment composition, such a cover film or sheet of barrier material may be applied to the applicator 10, such as across the open end of the base section 20 or lower cavity 24, e.g., may be applied to the base face 26. Such a cover film or sheet of barrier material may be of any suitable material, e.g., a synthetic polymer material, a metal or metallic foil or film, a metallized polymer film, multilayered materials, e.g., comprising at least two polymer layers and/or at least one polymer layer and at least one further layer such as a paper, cardboard, foil, metallic film and the like. The cover film or sheet of barrier material may be applied to the applicator using a suitable adhesive. Additionally or alternately the cover film or sheet of barrier material may be a rigid article, such as a cover or cap which may be fitted onto or adhered onto the applicator and removed prior to delivery of the adhesive lavatory treatment composition from the applicator.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

The invention claimed is:

1. A single use applicator adapted to dispense an adhesive lavatory composition which applicator comprises:

only a single dose of an adhesive lavatory composition being present within the applicator prior to any use of the applicator in applying an adhesive lavatory composition therefrom, and a piston part moveably engageable within a base part, wherein:

the piston part includes a piston plate, from which extend at least two outwardly extending stop means, and a grip element adapted to be gripped by a user of said applicator, and, the base part includes an upper cavity defined by a first sidewall containing the single dose of the adhesive lavatory composition, and a lower cavity of the base part defined by a second sidewall, and a flat perforated compression plate positioned intermediate the said upper cavity and the lower cavity as well as perpendicular to the first sidewall and the second sidewall, and, wherein the piston plate is fitted within the upper cavity of the base part and is moveable within the upper cavity of the base part by movement of the piston plate and the grip element until the said stop means engages parts of the base part which engagement inhibits or denies retraction of the piston part from the base part, and such that as the piston part is moved from an initial state to a final state which corresponds to the maximum movement of the piston part, it also contacts the perforated compression plate through which, all or most of the single dose of the adhesive lavatory composition is extruded from the upper cavity and into the lower cavity and onto a surface upon which the adhesive lavatory composition may be adhered.

2. An applicator according to claim 1 wherein the grip element is detachable from a piston plate of the piston part.

3. An applicator according to claim 1 wherein the applicator comprises two or more detents in the base section of the applicator which correspond to one or more stop means present in the applicator.

4. An applicator according to claim 1 wherein the grip element is generally perpendicular to the base section.

5. An applicator according to claim 1 wherein the piston plate comprises a release material.

6. An applicator according to claim 5, wherein the release material comprises a film.

7. An applicator according to claim 3 wherein the stop means provides an audible signal which may be heard by a consumer.

8. An applicator according to claim 1, wherein the volume of the lower cavity is greater than the volume of the upper cavity when the piston part is in its initial state.

9. An applicator according to claim 1, wherein the piston plate includes a plurality of piston plugs which extend outwardly from a bottom face of said piston plate, and are dimensioned to extend into corresponding orifices of said compression plate.

* * * * *